US010065078B2

(12) United States Patent
Martino

(10) Patent No.: US 10,065,078 B2
(45) **Date of Patent: *Sep. 4, 2018**

(54) ENHANCED SWIM FIN

(71) Applicant: Marc Gregory Martino, Westlake Village, CA (US)

(72) Inventor: Marc Gregory Martino, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/259,015

(22) Filed: Sep. 7, 2016

(65) Prior Publication Data

US 2018/0001145 A1 Jan. 4, 2018

Related U.S. Application Data

(60) Provisional application No. 62/215,263, filed on Sep. 8, 2015.

(51) Int. Cl.
*A63B 31/00* (2006.01)
*B63H 16/18* (2006.01)
*A63B 31/08* (2006.01)

(52) U.S. Cl.
CPC ..... *A63B 31/08* (2013.01)

(58) Field of Classification Search
CPC .... B63H 1/30; B63H 1/36; B63H 1/37; A63B 31/08; A63B 31/10; A63B 31/12; A63B 31/18; A63B 35/00; A63B 35/02; A63B 35/06; A63B 35/08; A63B 35/10
USPC ..... 440/21, 22, 25, 32; 441/55, 56
See application file for complete search history.

(56) References Cited

U.S. PATENT DOCUMENTS 1,530,560 A * 3/1925 Heminger ..... A63B 35/02 441/55
3,426,722 A * 2/1969 Dragich ..... A63B 35/02 441/55
3,440,994 A * 4/1969 McGowan ..... A63B 35/02 440/15
3,529,565 A * 9/1970 Iglesias ..... A63B 35/02 441/55
4,193,371 A * 3/1980 Baulard-Caugan .... A63B 35/02 440/15
4,869,696 A * 9/1989 Ciccotelli ..... A63B 31/11 441/55
6,524,145 B1 * 2/2003 Arzate ..... A63B 35/02 114/315
6,558,210 B2 * 5/2003 Frasier ..... B63C 11/46 440/14
6,561,862 B1 * 5/2003 Moore ..... A63B 35/02 440/14

(Continued)

*Primary Examiner* — Daniel V Venne
(74) *Attorney, Agent, or Firm* — Hackler Daghighiam Martino & Novak

(57) ABSTRACT

A swimming enhancement device has a frame and a push bar pivotably coupled to the rear portion of the frame. A left end is rotatably coupled to the left portion of the push bar and a left foot pad is pivotably coupled to the left end. A right end is rotatably coupled to the right portion of the push bar and a right foot pad is pivotably coupled to the right end. A propulsion fin is attached to the push bar or to a tail bar distal end of the push bar. A receiver is movably coupled to the front portion of the frame. A body coupling device is attached to or formed as part of the receiver. The body coupling device is configured to removably attach to a portion of a user's body or be held by the user.

20 Claims, 6 Drawing Sheets

(56) References Cited

U.S. PATENT DOCUMENTS 9,359,056 B2 * 6/2016 Lyons ..... B63H 16/20

* cited by examiner

ENHANCED SWIM FIN

CROSS-REFERENCE TO RELATED APPLICATIONS

This application claims priority to provisional application 62/215,263 filed on Sep. 8, 2015, the entire contents of which are fully incorporated herein with these references.

DESCRIPTION

Field of the Invention

The present invention generally relates to swim fins. More particularly, the present invention relates to an enhanced swim fin that utilizes the structural strength of the human body to channel energy more efficiently into creating propulsion for forward movement in water.

Background of the Invention

There is always a need for a better swim fin that requires less energy to move the swimmer forward in the water. For decades swimmers, divers and snorkelers have used fins that attach to one's feet. Typically the fins are planar extensions that increase the efficiency of a typical leg kick, the leg kick being a scissor-like motion. Some recent advancements have coupled a swimmer's legs together into various monofin designs that are more efficient than a standard swim fin.

A problem with all of the previous designs is that they are intended to utilize a swimmer's leg movement in a less than efficient motion. The legs of a human are more powerful in a squatting motion as compared to a scissor motion. Yet all swim fins force the swimmer to move in a scissor motion.

Accordingly, there is a need for a swim fin that can more efficiently capture the muscular strength and efficiency of human motion and transfer that into forward propulsion. The present invention fulfills these needs and provides other related advantages.

SUMMARY OF THE INVENTION

An exemplary embodiment of the present invention is a swimming enhancement device having: an elongated frame defined as extending along a first longitudinal axis from a front portion to a rear portion; an elongated push bar defined as extending along a second longitudinal axis from a left portion to a right portion centered about a middle portion, wherein the middle portion of the push bar is pivotably coupled to the rear portion of the frame, the push bar rotatable about a main axis with respect to the frame wherein the main axis is perpendicular with respect to the first longitudinal axis; a left end rotatably coupled to the left portion of the push bar, the left end rotatable about the second longitudinal axis; a left foot pad pivotably coupled to the left end, the left foot pad pivotable about a left foot pad axis that is perpendicular to the second longitudinal axis; a right end rotatably coupled to the right portion of the push bar, the right end rotatable about the second longitudinal axis; a right foot pad pivotably coupled to the right end, the right foot pad pivotable about a right foot pad axis that is perpendicular to the second longitudinal axis; a tail bar extending from the push bar to a tail bar distal end, the tail bar extending in a direction perpendicular to the second longitudinal axis; a propulsion fin attached to the tail bar distal end; a receiver movably coupled to the front portion of the frame, wherein the front portion can rotate about the first longitudinal axis with respect to the receiver, and wherein the front portion can translate along its first longitudinal axis with respect to the receiver; and a body coupling device attached to the receiver, the body coupling device configured to removably attach to a portion of a user's body or be held by the user.

In other exemplary embodiments, the swimming enhancement device may have a neutral buoyancy in water or salt water. Alternatively, the swimming enhancement device may have a positive buoyancy in water and salt water.

The propulsion fin may extend beyond the tail bar distal end and/or extend in a direction perpendicular to the tail bar and/or extend in a direction aligned with the main axis.

The body coupling device may include a pad and/or a strap configured to wrap around a portion of the user's body.

Alternatively, the body coupling device may include a handlebar having a right handle portion and a left handle portion. A right handle end may be rotatably coupled to the right handle portion, and wherein a left handle end may be rotatably coupled to the left handle portion. A right flipper may be attached to the right handle end, and wherein a left flipper may be attached to the left handle end. Rotation of the either the right or left flipper causes the user to change direction in the water when propelled forward by the propulsion fin.

The left foot pad may include a left foot strap configured to removably secure a user's left foot against the left foot pad. Similarly, the right foot pad may include a right foot strap configured to removably secure a user's right foot against the left foot pad.

Alternatively, the left foot pad may include a left clip assembly configured to be removably attachable to a left foot shoe worn by the user. Similarly, the right foot pad may include a right clip assembly configured to be removably attachable to a right foot shoe worn by the user.

The propulsion fin may comprise a resiliently flexible material and/or may be pivotably attached to the tail bar distal end or to the push bar itself.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

U.S. Pat. No. 8,763,551 issued on Jul. 1, 2014 by inventor Marc Martino is incorporated herein in its entirety with this reference. It is understood by those skilled in the art that any of the previous concepts, devices or teachings in the '551 patent can be applied to any of the embodiments herein, as both the '551 patent and this application utilize unique propulsion methods in water using new and novel fin mechanisms and the like.

Figure 1:
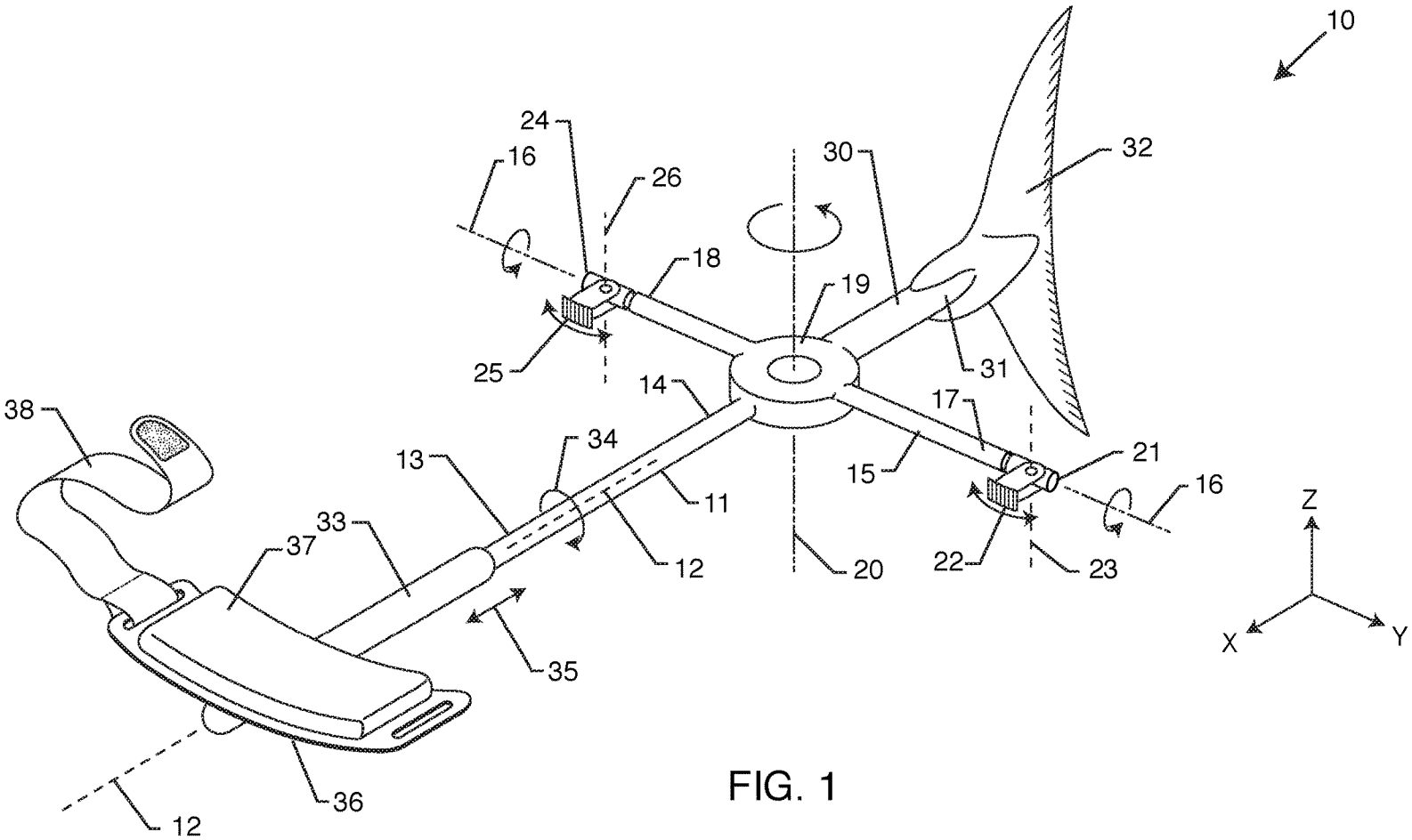
FIG. 1 is an isometric view of an exemplary enhanced swim fin embodying the present invention.

An exemplary embodiment of the present invention is shown in FIG. 1 which is a swimming enhancement device 10 (otherwise known as an enhanced swim fin 10) having an elongated frame 11 defined as extending along a first longitudinal axis 12 from a front portion 13 to a rear portion 14. A coordinate system is also shown in FIG. 1, such that it is clear the first longitudinal axis 12 extends along the X-axis. The frame 11 can be made from polymers, metals, composites or the like such that it is sufficiently strong enough to maintain its structural shape when in use.

An elongated push bar 15 is defined as extending along a second longitudinal axis 16 from a left portion 17 to a right portion 18 centered about a middle portion 19. The middle portion 19 of the push bar 15 is pivotably coupled to the rear portion 14 of the frame 11. The push bar 15 is rotatable about a main axis 20 with respect to the frame 11 wherein the main axis 20 is perpendicular with respect to the first longitudinal axis 12. In other words, the main axis 20 is aligned along the Z-axis when looking at the coordinate system of FIG. 1. This means the push bar 15 pivots about the Z-axis/main axis 20.

A left end 21 is rotatably coupled to the left portion 17 of the push bar 15. This means the left end 21 is rotatable about the second longitudinal axis 16. It must be kept in mind that the second longitudinal axis 16 does not always align with the Y-axis. This is because the push bar 15 can pivot about the main axis 20, such that the second longitudinal axis 16 will not align with the Y-axis. However, the left end 21 will always be rotatable about the second longitudinal axis 16, because it is rotatably attached to the left portion 17. A left foot pad 22 is pivotably coupled to the left end 21. The left foot pad 22 is pivotable about a left foot pad axis 23 that is perpendicular to the second longitudinal axis 16.

Similarly, a right end 24 is rotatably coupled to the right portion 18 of the push bar 15. The right end 24 is rotatable about the second longitudinal axis 16. A right foot pad 25 is pivotably coupled to the right end 14. The right foot pad 25 is pivotable about a right foot pad axis 26 that is perpendicular to the second longitudinal axis 16.

Figure 3C:
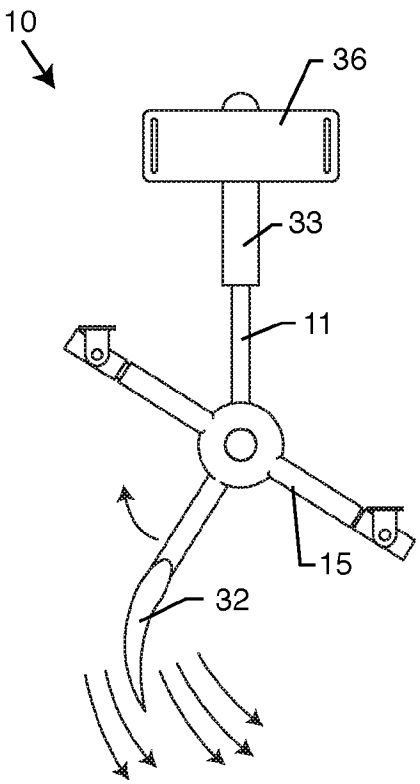
FIG. 3C is a top view of the structure of FIG. 1 now with the push bar pivoted and extended by the swimmer's right foot.
Figure 3B:
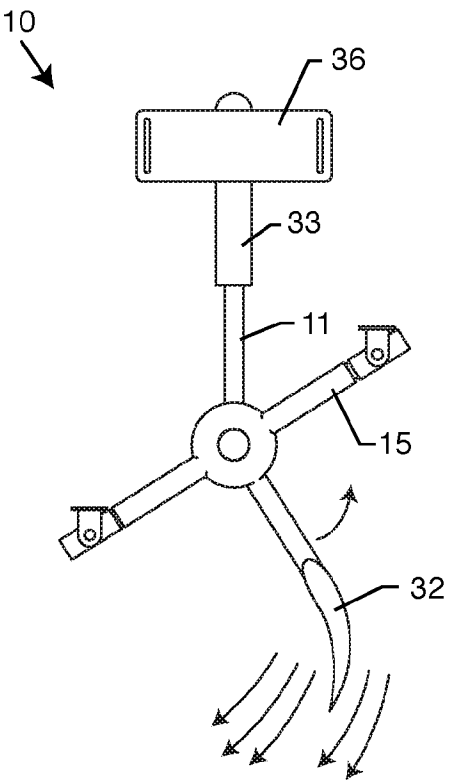
FIG. 3B is a top view of the structure of FIG. 1 now with the push bar pivoted and extended by the swimmer's left foot.
Figure 3A:
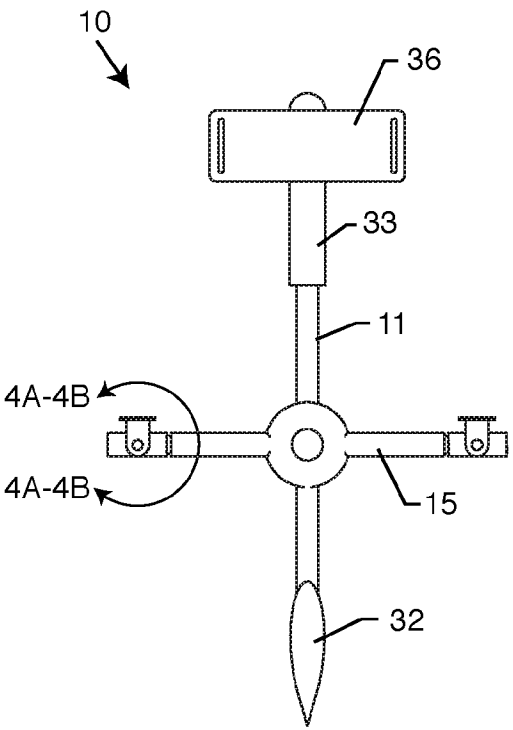
FIG. 3A is a top view of the structure of FIG. 1.
Figure 4A:
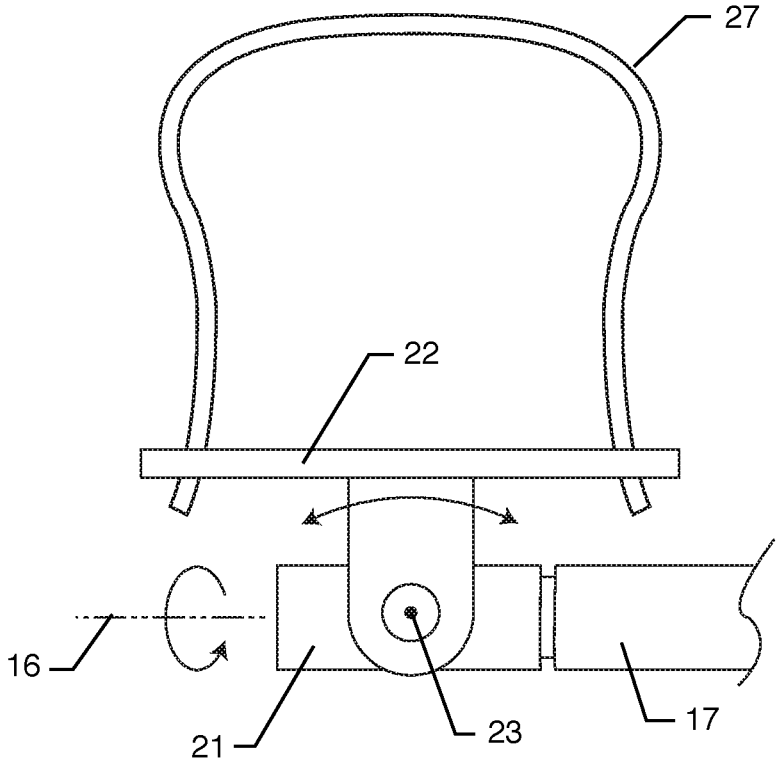
FIG. 4A is an enlarged view of the structure of FIG. 3A taken along lines 4A-4A from FIG. 3A now showing a foot strap assembly.

Referring now to FIG. 4A, an enlarged view is shown of one embodiment of a foot pad assembly. FIG. 4A is taken from the structure of FIG. 3A along lines 4A-4A, but could also be taken from the structure shown in FIG. 1. The left foot pad 22 (or similarly right foot pad 25) may include a left foot strap 27 configured to removably secure a user's left foot against the left foot pad 22. Similarly, the right foot pad may include a right foot strap configured to removably secure a user's right foot against the left foot pad. There are many structures that one skilled in the art could use and device that allows a user to secure one's foot to the foot pads, as this teaching is not intended to limit its structure to just the embodiments shown herein. However, it is desired that the user's foot when attached to the device 10 can pivot about the left and right foot pad axes 23 and 26 and also pivot about the second longitudinal axis 16. This movement keeps the user's feet from binding or being torqued uncomfortably as the user pushes or pulls on the push bar with the user's feet.

Figure 2:
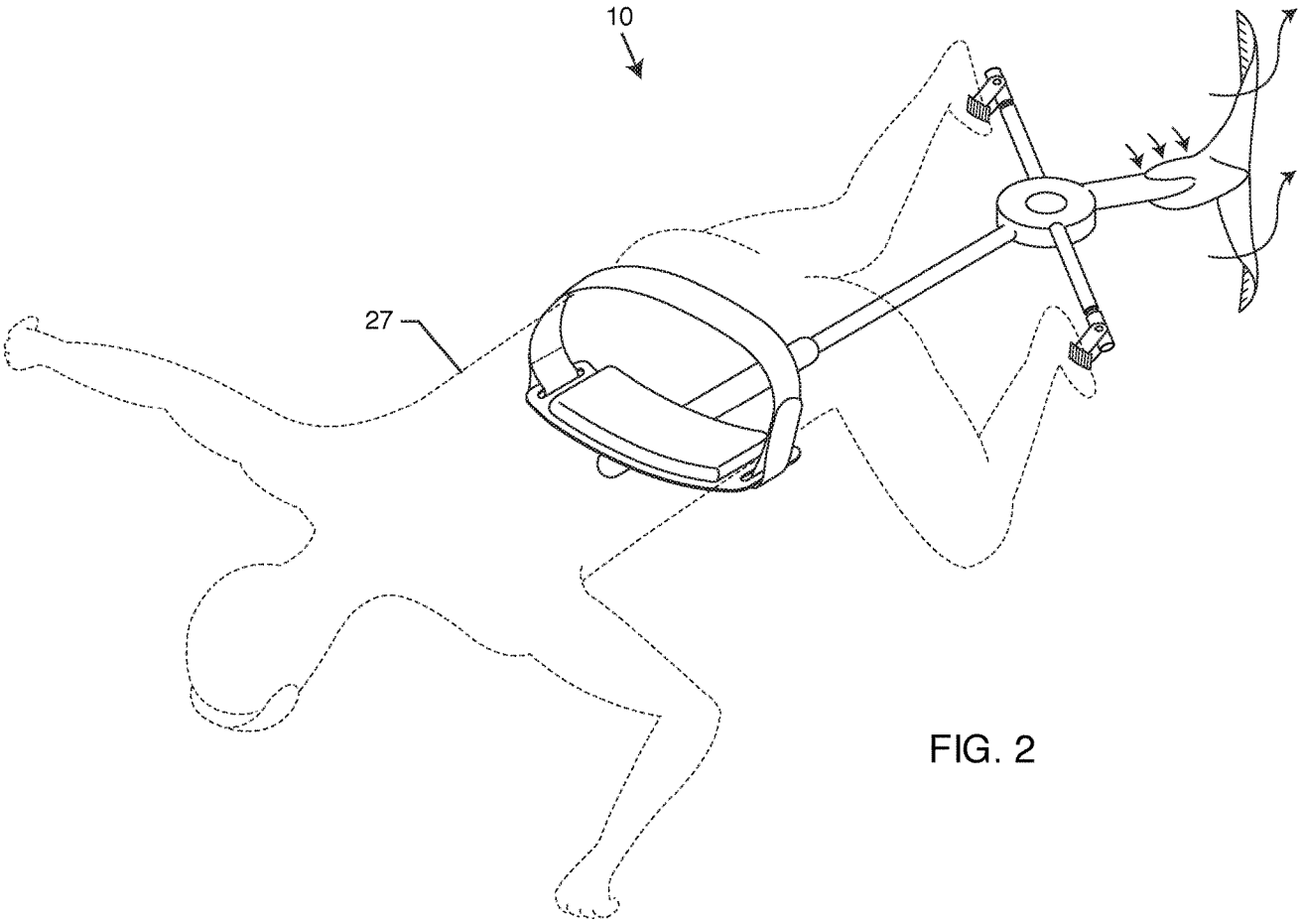
FIG. 2 is an isometric view of the structure of FIG. 1 now showing a swimmer utilizing the present invention.

For example, FIG. 2 shows a user 27 utilizing the device 10, where the user 27 is shown in dashed lines and is operating the device 10 by pressing and pulling on the push bar 15 with the user's feet. Allowing for the various rotations provides ease of use and comfort while still transferring pushing and pulling power into the push bar 15. However, it will be understood that the left and right ends 21 and 24 could be eliminated in the most simplistic version of the present invention and the user could then push directly against the left portion 17 or right portion 18 of the push bar 15. While this is not optimal, it is still possible.

Figure 4B:
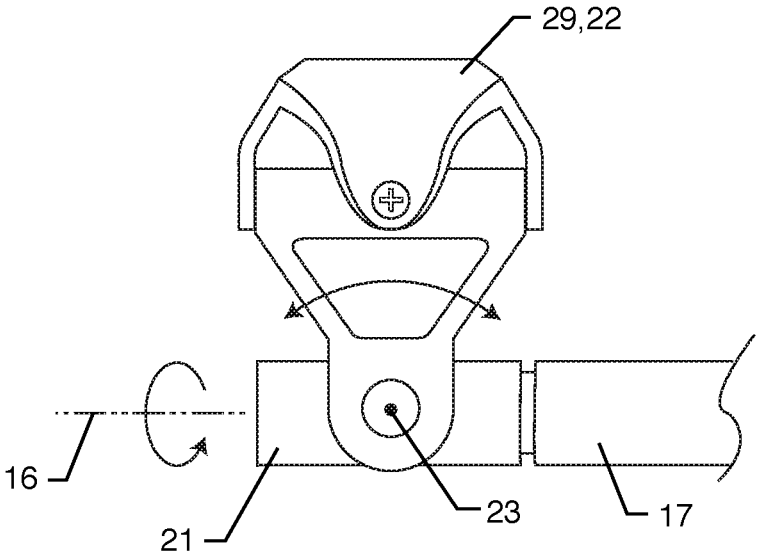
FIG. 4B is an enlarged view of the structure of FIG. 3A taken along lines 4B-4B from FIG. 3A now showing a foot clip assembly.
Figure 5A:
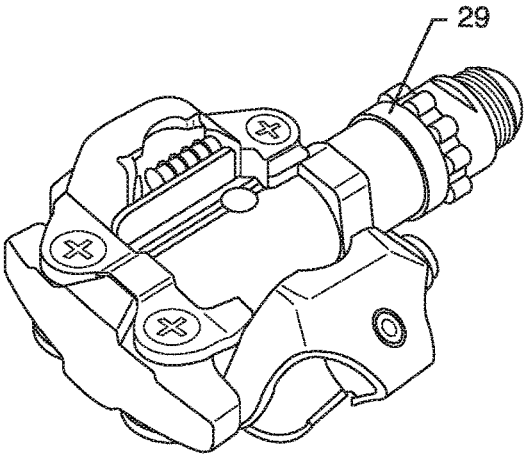
FIG. 5A PRIOR ART
FIG. 5A is a prior art perspective view of a peddle clip assembly for a bicycle.
Figure 5B:
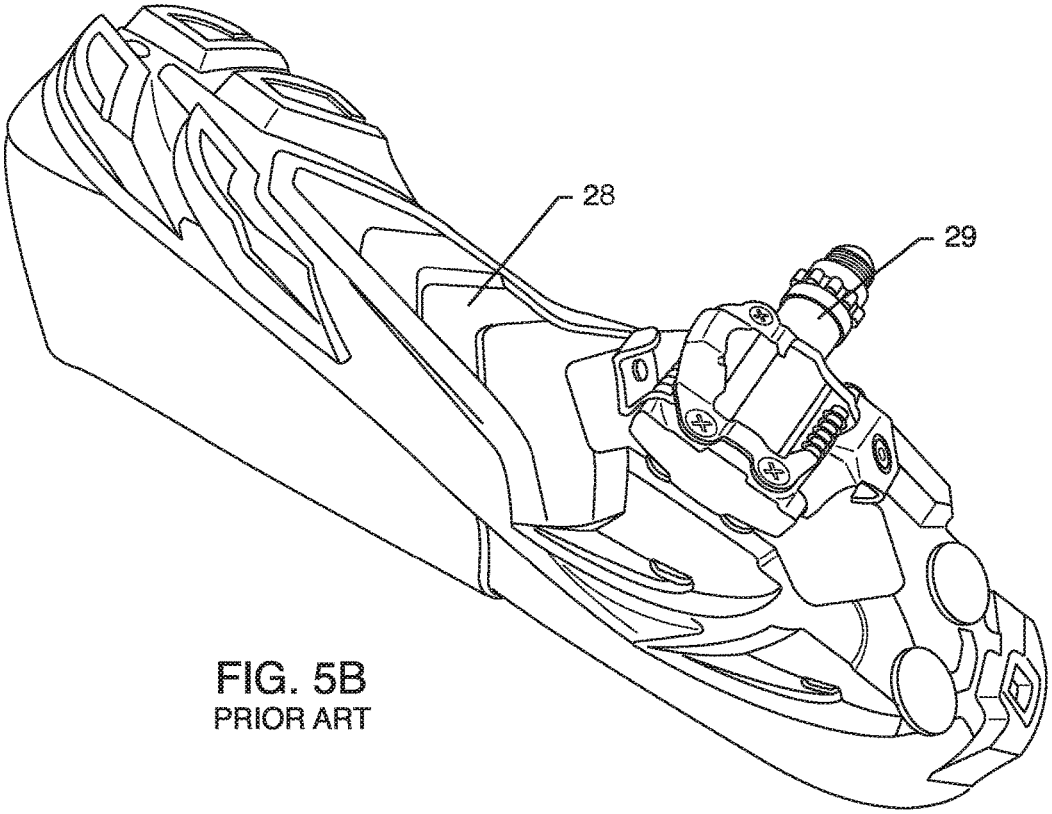
FIG. 5B PRIOR ART
FIG. 5B is a prior art perspective view of a biking shoe configured to removable attach to the peddle clip assembly of FIG. 5A.

As shown in FIGS. 5A and 5B, the left and right foot pads may be replaced with clip assemblies similar to those used in bicycles. FIG. 5A shows a prior art foot clip assembly 29. FIG. 5B shows a prior art bicycle shoe assembly. The present invention could incorporate such structures such that the user 27 would wear the shoes 28 and then clip the shoes 28 into a left and right clip assembly 29. FIG. 4B shows such an embodiment of a clip assembly 29, where FIG. 4B is an alternative embodiment of FIG. 4A. While it may seem odd to wear shoes when swimming, the shoes would provide a very effective way of locking the user's feet to the push bar 15.

Referring back to FIG. 1, a tail bar 30 (i.e. extension, support, strut) extends from the push bar 15 (or from the middle portion 19 of the push bar 15) to a tail bar distal end 31. The tail bar 30 extends in a direction perpendicular to the second longitudinal axis 16. A propulsion fin 32 is attached to the tail bar distal end 31. The propulsion fin 32 may extend beyond the tail bar distal end and/or extend in a direction perpendicular to the tail bar and/or extend in a direction aligned with the main axis. The propulsion fin 32 can also take on the shape of various fish or other ocean going animals such as whales, dolphin, sharks and the like. Alternatively, the propulsion fin 32 may take on any shape that allows it to function appropriately in the water to create propulsion. Also, the propulsion fin 32 may comprise a resiliently flexible material and/or may be pivotably attached (as shown in the '551 patent) to the tail bar distal end or to the push bar itself. FIG. 2 shows the propulsion fin 32 in action and how it flexes like the tail fin of a fish to create forward propulsion when in use.

Referring back to FIG. 1, a receiver 33 is movably coupled to the front portion 13 of the frame 11. The receiver 33 couples to and allows for movement of the frame 11. The front portion 13 of the frame 11 can rotate 34 about the first longitudinal axis 12 with respect to the receiver 33, and the front portion 13 can translate 35 along its first longitudinal axis 16 with respect to the receiver 33.

A body coupling device 36 is attached to the receiver 33. The body coupling device may be configured to removably attach to a portion of a user's body or be held by the user. The body coupling device 36 may include a pad 37 and/or a strap 38 configured to wrap around a portion of the user's body, which is best seen in FIG. 2. The strap 38 can include a buckle or hook-and-loop fasteners to lock it down thereby securing it around the user 27.

The swimming enhancement device 10 may have a neutral buoyancy in water or salt water. This means the device 10 doesn't want to float or sink, allowing the user 27 to fully control movement in the water. Alternatively, the swimming enhancement device 10 may have a positive buoyancy in water and salt water. This would then allow the user 27 to let go of the device while in the water and not have the device 10 sink. This may be very advantageous such that the device 10 is not lost. Furthermore, a positive buoyancy would also aid the user in staying afloat for activities such as snorkeling.

Figure 6:
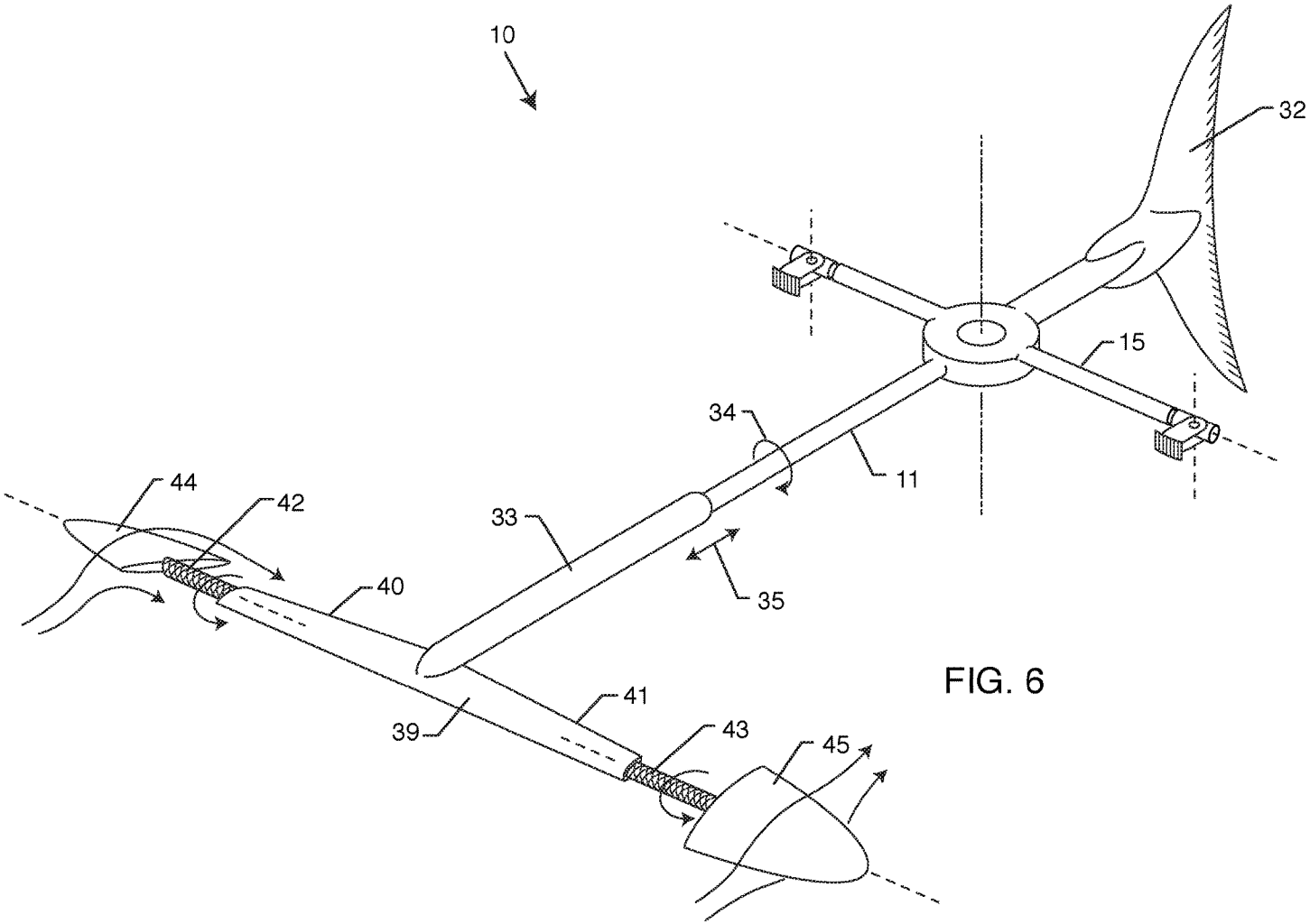
FIG. 6 is an isometric view of another exemplary enhanced swim fin embodying the present invention now showing a handlebar assembly with steerable flippers.

As shown in FIG. 6, the body coupling device 33 may include a handlebar 39 having a right handle portion 40 and a left handle portion 41. A right handle end 42 may be rotatably coupled to the right handle portion 40, and a left handle end 43 may be rotatably coupled to the left handle portion 41. A right flipper 44 may be attached to the right handle end 42, and a left flipper 45 may be attached to the left handle end 43. The user 27 can then grip the right and left handle ends when using the device 10. Rotation by the user of the either the right or left flipper causes the user 27 to change direction in the water when propelled forward by the propulsion fin 32.

FIG. 3A is a top view of the structure of FIG. 1. FIG. 3A is showing the device 10 in a neutral position creating no propulsion.

FIG. 3B is a top view of the structure of FIG. 1 now with the push bar 15 pivoted and extended by the user's left foot where then the user's right foot would be retracted. As the push bar 15 pivots counter-clockwise, it swings the propulsion fin 32 to the right. As the propulsion fin 32 flexes, it creates forward thrust/propulsion in the water in the same manner a fish propels forward.

FIG. 3C is a top view of the structure of FIG. 1 now with the push bar pivoted and extended by the user's right foot where then the user's left foot is retracted. As the push bar 15 pivots clockwise, it swings the propulsion fin 32 to the left. As the propulsion fin 32 flexes, it creates forward thrust/propulsion in the water. As can be understood, as the user 27 moves the push bar back and forth between FIGS. 3B and 3C forward propulsion is obtained. The user 27 is utilizing the larger muscles and bone structure of the human body to push and pull the push bar 15, rather than trying to kick like one is swimming. The device 10 generates substantially more forward propulsion as compared to traditional fins and exhausts the user's energy at a slower rate in comparison to traditional fins. For these reason, the present invention is a vast improvement over the prior art enabling a human to transfer one's energy into forward motion in water in a more efficient manner.

Referring back to FIG. 1, it is herein noted that the purpose of the frame 11 being attached to the user's body is such that the push bar 15 does not rotate about the Y-axis. This is accomplished by the pivot joint at the middle portion 19 of the push bar 15 that is rotatably coupled to the rear portion 14 of the frame 11. If the push bar 15 was to rotate generally about the Y-axis it would prevent the fin 32 from moving in the correct orientation necessary to produce thrust. Yet, the receiver 33 allows the frame 11 to translate 35 and rotate 34 which provides much needed motion to the user 27, yet while at the same time preventing the push bar 15 and the fin 32 from rotating about the Y-axis. If the frame 11 and receiver 33 were not used, the push bar 15 would flip and/or flop in the wrong direction as the proper alignment of the fin 32 relative to the user 27 would not be maintained.

In a more simplistic embodiment not shown, the frame 11 could extend outward without a receiver 33 and the user 27 simply hold onto the frame 11 to establish control over the push bar 15, yet this might be difficult to achieve in practice and requires a constant grip to be maintained by the user.

Although several embodiments have been described in detail for purposes of illustration, various modifications may be made to each without departing from the scope and spirit of the invention. Accordingly, the invention is not to be limited, except as by the appended claims.

NUMERALS

10 enhanced swim fin
11 elongated frame
12 first longitudinal axis
13 front portion, frame
14 rear portion, frame
15 elongated push bar
16 second longitudinal axis
17 left portion, push bar
18 right portion, push bar
19 middle portion, push bar
20 main axis
21 left end
22 left foot pad
23 left foot pad axis
24 right end
25 right foot pad
26 right foot pad axis
27 user
28 bicycle shoe
29 bicycle clip assembly
30 tail bar
31 tail bar distal end
32 propulsion fin
33 receiver
34 rotate
35 translate
36 body coupling device
37 pad
38 strap
39 handle bar
40 right handle portion
41 left handle portion
42 right handle end
43 left handle end
44 right flipper
45 left flipper

What is claimed is:

1. A swimming enhancement device, comprising:

an elongated frame defined as extending along a first longitudinal axis from a front portion to a rear portion;

an elongated push bar defined as extending along a second longitudinal axis from a left portion to a right portion centered about a middle portion, wherein the middle portion of the elongated push bar is pivotably coupled to the rear portion of the elongated frame, the elongated push bar rotatable about a main axis with respect to the elongated frame wherein the main axis is perpendicular with respect to the first longitudinal axis;

a left end rotatably coupled to the left portion of the elongated push bar, the left end rotatable about the second longitudinal axis;

a left foot pad pivotably coupled to the left end, the left foot pad pivotable about a left foot pad axis that is perpendicular to the second longitudinal axis;

a right end rotatably coupled to the right portion of the elongated push bar, the right end rotatable about the second longitudinal axis;

a right foot pad pivotably coupled to the right end, the right foot pad pivotable about a right foot pad axis that is perpendicular to the second longitudinal axis;

a tail bar extending from the elongated push bar to a tail bar distal end, the tail bar extending in a direction perpendicular to the second longitudinal axis;

a propulsion fin attached to the tail bar distal end;

a receiver movably coupled to the front portion of the elongated frame, wherein the front portion can rotate about the first longitudinal axis with respect to the receiver, and wherein the front portion can translate along the first longitudinal axis with respect to the receiver; and a body coupling device attached to the receiver, the body coupling device configured to removably attach to a portion of a user's body or be held by the user.

2. The device of claim 1, wherein the swimming enhancement device has a neutral buoyancy in water or salt water.

3. The device of claim 1, wherein the swimming enhancement device has a positive buoyancy in water and salt water.

4. The device of claim 1, wherein the propulsion fin extends beyond the tail bar distal end and/or extends in a direction perpendicular to the tail bar and/or extends in a direction aligned with the main axis.

5. The device of claim 1, wherein the body coupling device comprises a pad and/or a strap configured to wrap around a portion of the user's body.

6. The device of claim 1, wherein the body coupling device comprises a handlebar having a right handle portion and a left handle portion.

7. The device of claim 6, wherein a right handle end is rotatably coupled to the right handle portion, and wherein a left handle end is rotatably coupled to the left handle portion.

8. The device of claim 7, wherein a right flipper is attached to the right handle end, and wherein a left flipper is attached to the left handle end, wherein rotation of the either the right or left flipper causes the user to change direction in the water when propelled forward by the propulsion fin.

9. The device of claim 1, wherein the left foot pad comprises a left foot strap configured to removably secure a user's left foot against the left foot pad, and wherein the right foot pad comprises a right foot strap configured to removably secure a user's right foot against the left foot pad.

10. The device of claim 1, wherein the left foot pad comprises a left clip assembly configured to be removably attachable to a left foot shoe worn by the user, and wherein the right foot pad comprises a right clip assembly configured to be removably attachable to a right foot shoe worn by the user.

11. The device of claim 1, wherein the propulsion fin comprises a resiliently flexible material.

12. The device of claim 1, wherein the propulsion fin is pivotably attached to the tail bar distal end.

13. A swimming enhancement device, comprising:

an elongated frame defined as extending along a first longitudinal axis from a front portion to a rear portion;

an elongated push bar defined as extending along a second longitudinal axis from a left portion to a right portion centered about a middle portion, wherein the middle portion of the elongated push bar is pivotably coupled to the rear portion of the elongated frame, the elongated push bar rotatable about a main axis with respect to the elongated frame wherein the main axis is perpendicular with respect to the first longitudinal axis;

a left end rotatably coupled to the left portion of the elongated push bar, the left end rotatable about the second longitudinal axis;

a left foot pad pivotably coupled to the left end, the left foot pad pivotable about a left foot pad axis that is perpendicular to the second longitudinal axis;

a right end rotatably coupled to the right portion of the elongated push bar, the right end rotatable about the second longitudinal axis;

a right foot pad pivotably coupled to the right end, the right foot pad pivotable about a right foot pad axis that is perpendicular to the second longitudinal axis;

a tail bar extending from the elongated push bar to a tail bar distal end, the tail bar extending in a direction perpendicular to the second longitudinal axis; and a propulsion fin attached to the tail bar distal end.

14. The device of claim 13, including a receiver movably coupled to the front portion of the elongated frame, wherein the front portion can rotate about the first longitudinal axis with respect to the receiver, and wherein the front portion can translate along the first longitudinal axis with respect to the receiver.

15. The device of claim 14, including a handlebar attached to the receiver, the handlebar having a right handle portion and a left handle portion.

16. The device of claim 15, wherein a right handle end is rotatably coupled to the right handle portion, and wherein a left handle end is rotatably coupled to the left handle portion.

17. The device of claim 16, wherein a right flipper is attached to the right handle end, and wherein a left flipper is attached to the left handle end, wherein rotation of the either the right or left flipper causes the user to change direction in the water when propelled forward by the propulsion fin.

18. The device of claim 13, including a pad and/or a strap attached to the receiver, wherein the pad and/or the strap is configured to wrap around a portion of the user's body.

19. A swimming enhancement device, comprising:

an elongated frame defined as extending along a first longitudinal axis from a front portion to a rear portion;

an elongated push bar defined as extending along a second longitudinal axis from a left portion to a right portion centered about a middle portion, wherein the middle portion of the elongated push bar is pivotably coupled to the rear portion of the elongated frame, the elongated push bar rotatable about a main axis with respect to the elongated frame wherein the main axis is perpendicular with respect to the first longitudinal axis;

a left end rotatably coupled to the left portion of the elongated push bar, the left end rotatable about the second longitudinal axis;

a left foot pad pivotably coupled to the left end, the left foot pad pivotable about a left foot pad axis that is perpendicular to the second longitudinal axis;

a right end rotatably coupled to the right portion of the elongated push bar, the right end rotatable about the second longitudinal axis;

a right foot pad pivotably coupled to the right end, the right foot pad pivotable about a right foot pad axis that is perpendicular to the second longitudinal axis;

a propulsion fin attached to the elongated push bar disposed on an opposite side from the elongated frame;

a receiver movably coupled to the front portion of the elongated frame, wherein the front portion can rotate about the first longitudinal axis with respect to the receiver, and wherein the front portion can translate along the first longitudinal axis with respect to the receiver; and a body coupling device attached to the receiver, the body coupling device configured to removably attach to a portion of a user's body or be held by the user.

20. The device of claim 19, wherein the swimming enhancement device has a positive buoyancy in water and salt water.

* * * * *